US012349851B2

(12) United States Patent
Dirnberger et al.

(10) Patent No.: US 12,349,851 B2
(45) Date of Patent: Jul. 8, 2025

(54) DOOR MECHANISM OF A DOMESTIC ELECTRICAL APPLIANCE WITH A FUNCTION FOR AUTOMATIC DOOR OPENING

(71) Applicant: emz-Hanauer GmbH & Co. KGaA, Nabburg (DE)

(72) Inventors: Albert Dirnberger, Neunburg vom Wald (DE); Benjamin Schemela, Schwarzenbach (DE); Ren Shaojiang, Nanjing (CN)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 450 days.

(21) Appl. No.: 17/824,970

(22) Filed: May 26, 2022

(65) Prior Publication Data

US 2022/0378274 A1 Dec. 1, 2022

(51) Int. Cl.
*A47L 15/42* (2006.01)

(52) U.S. Cl.
CPC ..... *A47L 15/4259* (2013.01); *A47L 15/4261* (2013.01); *A47L 2401/26* (2013.01); *A47L 2501/22* (2013.01)

(58) Field of Classification Search
CPC ..... A47L 15/4259
See application file for complete search history.

(56) References Cited

U.S. PATENT DOCUMENTS

| | | | | |
|---|---|---|---|---|
| 9,380,924 | B2 | 7/2016 | Dirnberger et al. | |
| 2006/0283482 | A1 * | 12/2006 | Berends | A47L 15/0034 134/25.2 |

FOREIGN PATENT DOCUMENTS

| | | | | |
|---|---|---|---|---|
| CN | 107882467 | A | 4/2018 | |
| CN | 112006625 | A | 12/2020 | |
| DE | 102012016541 | A1 | 2/2014 | |
| DE | 202017218493 | A1 | 4/2019 | |
| DE | 102018202026 | A1 | 8/2019 | |
| EP | 1733675 | A2 | 12/2006 | |
| EP | 2210547 | A1 | 7/2010 | |
| EP | 2436864 | A1 | 4/2012 | |
| WO | 2011003714 | A1 | 1/2011 | |
| WO | 2015071157 | A1 | 5/2015 | |
| WO | WO-2016020082 | A1 * | 2/2016 | A47L 15/4259 |

* cited by examiner

*Primary Examiner* — David G Cormier
(74) *Attorney, Agent, or Firm* — Hayes Soloway PC

(57) ABSTRACT

A door mechanism, for example for a domestic dishwasher, is disclosed, wherein the door mechanism includes a door latch for holding a door of the dishwasher closed in a closed position, and an electrically controllable door opener for the mechanized partial opening and subsequent closing of the door. The door opener includes coupling members, which can be brought into push- and pull-transmitting but releasable coupling engagement with one another, on the door and on an appliance main body of the dishwasher on which the door is movably mounted. The coupling members, when in coupling engagement, allow forces to be transmitted between the door and the appliance main body in a force transmission path which runs past the door latch. The pull strength of the coupling engagement of the coupling members can be variable in dependence on the position of the door.

14 Claims, 6 Drawing Sheets

DOOR MECHANISM OF A DOMESTIC ELECTRICAL APPLIANCE WITH A FUNCTION FOR AUTOMATIC DOOR OPENING

CROSS-REFERENCE TO RELATED APPLICATIONS

This application claims priority to German Patent Application 10 2021 113 554.0, filed on May 26, 2021, the contents of which are incorporated by reference herein.

TECHNICAL FIELD

The present invention relates generally to the field of domestic electrical appliances which are designed with a process chamber (useable chamber) which can be closed by a door. In particular, the invention relates to a domestic electrical appliance which is equipped with a door opener for opening the door automatically, that is to say without intervention by a user, for example after an operating program of the domestic appliance has been performed.

BACKGROUND

Many electrical appliances for domestic use, such as, for example, washing machines, dishwashers, tumble dryers, microwave ovens, baking ovens and the like, have a door which can be held in a closed position by means of a door latch. When the door is in the closed position, an access opening to a process chamber of the domestic appliance is closed. In a washing machine or a tumble dryer, the process chamber is the laundry chamber into which the laundry to be washed or dried is introduced. In a dishwasher, the dishwashing chamber into which the dishes to be cleaned are placed forms such a process chamber, and in an oven (microwave oven, baking oven) it is the cooking chamber into which the item to be heated or cooked is placed.

At the end of a program run of an operating program, it can be desirable at least in some of these types of domestic electrical appliance to partially open the door automatically so that an opening gap of, for example, a few centimeters is formed between the door and an appliance main body of the domestic appliance on which the door is movably mounted. In the case of a washing machine, a tumble dryer or a dishwasher, hot steam can quickly escape from the appliance through the opening gap. Various solutions have been proposed in the prior art for automatic door opening; reference is made in this respect to WO 2015/071157 A1, EP 2 210 547 A1, EP 1 733 675 A2 and WO 2011/003714 A1, for example.

In the case of dishwashers in particular, it is desirable to completely dry the dishes located in the machine before the user removes the dishes from the machine and puts them away. In the case of automatic partial door opening, moisture in the form of hot steam can quickly escape. However, if the door is left in its partially open position for a prolonged period of time, heat increasingly escapes from the dishwashing chamber and is no longer available for further drying of the dishes. Once the dishwashing chamber has correspondingly cooled down, residual drying of the dishes can take a comparatively long time.

SUMMARY

It is an object of embodiments of the present invention to permit energy-efficient operation in a domestic electrical appliance such as, e.g., a dishwasher.

In order to achieve this object, one aspect of the present invention provides a domestic electrical appliance comprising: a process chamber; a door for closing the process chamber; a door opener device for automatically partially opening and closing the door; and a control unit configured to control the door opener device to perform at least one of the following operation cycles during execution of an operating program of the appliance: an open-close cycle of partially opening the door and subsequently closing, in at least one of a temperature-controlled manner, a time-controlled manner and a humidity-controlled manner, the partially opened door; and a repeat-open cycle of repeatedly partially opening the door and closing the door therebetween. In certain embodiments, the control unit is configured to control the door opener device to perform the at least one operation cycle on completion of a wet operating phase of the operating program.

Some embodiments of the present invention provide a domestic electrical appliance, in particular a dishwasher, which comprises a process chamber, which can be closed by a door, and a door opener for the mechanized partial opening and subsequent closing of the door. According to the invention, the domestic appliance is adapted to control the door opener such that the door opener, in connection with an operating cycle of the domestic appliance, in particular on completion of a wet operating phase of the operating cycle, automatically partially opens the door and then closes it under time control or/and temperature control or/and humidity control at least once or/and automatically repeatedly partially opens the door and closes it therebetween.

By automatically closing the door after it has been partially opened, it is possible, for example in a dishwasher, to prevent too much heat from escaping from the dishwashing chamber. The warm air that remains in the dishwashing chamber can then absorb further moisture from the still wet dishes; passive drying of the dishes can thus be improved, which is advantageous for the electrical energy requirement of the appliance. In particular, moisture absorbed by the air in the dishwashing chamber can be discharged to the outside intermittently by repeatedly partially opening the door automatically (and closing it automatically therebetween). Passive drying of the dishes can thus further be improved. Accordingly, it can be ensured that all the heat does not escape from the dishwashing chamber the first time the door is partially opened; instead, by repeated automatic opening and closing, the residual heat that remains in the dishwashing chamber can be used to assist further drying of the dishes in an energy-saving manner.

How often the door opener device partially opens the door automatically in connection with an operating cycle of the domestic appliance is not numerically limited within the scope of the invention. It can be sufficient in some embodiments to open the door by means of the door opener only once or twice in succession, while in other embodiments this can occur three times or even more often, in each case with an intermediate closing operation. The opening time can be identical or of a different duration from one opening phase to another. Thus it is conceivable, for example, after a first, comparatively brief opening of the door, to make the opening phase slightly longer for the second time. However, it is also possible, conversely, to shorten the opening time from one time to the next.

In the case of the automated gap opening (i.e. partial opening to such an extent that a gap forms) by means of the door opener, the gap that forms is, at least in some embodiments, sufficiently large, at least at a point at which the gap opening is at its largest, that a human finger fits into the gap.

On subsequent automatic closing of the door by means of the door opener, there is then the problem that it is not impossible that a user or a playing child intentionally or unintentionally still has a finger in the gap when the closing operation is initiated. This entails the risk of serious and painful finger injuries. It is therefore desirable to have available solutions with which such finger injuries can be prevented.

One possible solution consists in providing a door mechanism for a domestic electrical appliance, comprising a door latch for holding a door of a domestic appliance closed in a closed position, and a controllable door opener for the mechanized partial opening and subsequent closing of the door. The door opener, which in particular can be electrically controllable, comprises coupling members configured to be brought into push- and pull-transmitting but releasable coupling engagement with one another. These coupling members are arranged on the door and on an appliance main body of the domestic appliance on which the door is movably mounted and—when they are in coupling engagement with one another—allow forces to be transmitted between the door and the appliance main body in a force transmission path which runs past (i.e. bypasses) the door latch. According to the invention, the pull strength of the coupling engagement is variable. The higher the pull strength, the greater the pulling forces which can be transmitted between the door and the appliance main body via the coupling members.

The transmission of pulling forces via the coupling members is required in order to be able to close the previously partially opened door by means of the door opener. The variability of the pull strength of the coupling engagement makes it possible, in particular in a phase in which the opening gap between the door and the appliance main body is still sufficiently large that a human finger can be inserted into the gap, to operate the door opener in closing operation with a comparatively lower pull strength of the coupling engagement. As soon as the opening gap has become too small for a human finger to be able to be inserted, the pull strength of the coupling engagement can be increased.

In particular, the relatively lower pull strength can be so low that, in the case where there is a finger in the gap, automatic release of the coupling engagement of the coupling members occurs as soon as the finger in the gap presents a resistance to further closing of the door. The risk of finger injuries can thus successfully be counteracted.

By contrast, the comparatively greater pull strength of the coupling engagement can be sufficiently great to overcome a closing resistance of the door latch. Specifically, it can be that, when the door is opened by means of the door opener, the door latch is opened at the same time, that is to say a force-based connection running between the door and the appliance main body via the door latch is separated. In order to re-establish the force-based connection via the door latch, a specific initial force is first required, at least in some configurations of the door latch, to overcome a closing resistance of the door latch. In a phase of automatic closing of the door, in which closing formations of the door latch arranged on the door and on the appliance main body come into closing engagement with one another again, the pull strength of the coupling engagement is advantageously sufficiently high to overcome any initial resistance of these closing formations to establishment of the closing engagement.

The preceding explanations make it clear that—generally speaking—it can be desirable, where there is a relatively larger gap between the door and the appliance main body, to achieve a comparatively lower pull strength of the coupling engagement of the coupling members and, by contrast, where there is a relatively smaller gap, to achieve a comparatively higher pull strength of the coupling engagement. Accordingly, it is provided in some embodiments that the pull strength of the coupling engagement varies in dependence on the relative position between the door and the appliance main body. In this case, the pull strength of the coupling engagement can be lower in a first partially open position, in which the door is open wider, than in a second partially open position, in which the door is open less wide.

s A comparatively higher pull strength of the coupling engagement can—as explained—be required in order to overcome a closing resistance of the door latch on closing of the door. The coupling members should not be undesirably released from the coupling engagement while the force-based connection via the door latch is being re-established. However, once the force-based connection via the door latch has been re-established and the door has been closed completely, an increased pull strength of the coupling engagement of the coupling members is no longer required, at least in some embodiments. When the door is closed, it is to be possible in some embodiments for a user to open the door manually with a comparatively low force. If the coupling members of the door opener still remain in coupling engagement when the door is closed, the coupling engagement should at least not require any excessive additional force for the user to be able to pull the closed door open.

According to some embodiments, a transfer of the door, effected by means of the door opener and starting from the closed position of the door, into a partially open end position separates a force-based connection between the appliance main body and the door via the door latch. A subsequent closing of the door effected by means of the door opener re-establishes the force-based connection between the appliance main body and the door via the door latch. The pull strength of the coupling engagement in the partially open end position is not sufficient to overcome a closing resistance of the door latch. However, on closing of the door by means of the door opener, the pull strength of the coupling engagement increases at least temporarily to an extent that is sufficient to overcome the closing resistance of the door latch. The partially open end position is a position which can be reached by means of the door opener and in which the opening gap of the door is as large as possible.

In some embodiments, the pull strength of the coupling engagement of the coupling members of the door opener is variable stepwise. It is nevertheless not impossible within the scope of the invention to configure the pull strength of the coupling engagement to be continuously variable.

According to some embodiments, the coupling members have pulling coupling formations which are arranged so as to be deflectable relative to one another. The pull strength of the coupling engagement of the coupling members can in this case be increased by blocking or impeding the relative deflectability of the pulling coupling formations.

For example, a first of the coupling members can comprise a pivotably arranged coupling arm having a coupling lug with which the coupling arm is pivotable out of a released pivot position behind a recess of a second of the coupling members into a coupled pivot position in order to establish pull-transmitting coupling engagement. In order to increase the pull strength of the coupling engagement, pivoting of the coupling arm out of the coupled pivot position back into the released pivot position can be impeded or blocked.

Thus, some embodiments provide that the coupling arm is pivotably mounted on a push element which is arranged so as to be movable between an advanced position and a retracted position. Along the movement path of the push element between the advanced position and the retracted position, pivoting of the coupling arm out of the coupled pivot position into the released pivot position is relatively easier in at least a partial region of the movement path, whereas such pivoting of the coupling arm is relatively more difficult or is prevented in at least another partial region of the movement path.

Some embodiments provide that, both in the advanced position and in the retracted position of the push element, pivoting of the coupling arm out of the coupled pivot position into the released pivot position is relatively easier, whereas in a partial region of the movement path between the advanced position and the retracted position of the push element, such pivoting is relatively more difficult or is prevented.

Pivoting of the coupling arm out of the coupled pivot position into the released pivot position can be made relatively more difficult or prevented, for example, by a blocking face arranged stationarily on the door or on the appliance main body or alternatively by an abutment face arranged in a yielding manner against a spring resistance. When the push element moves from the retracted position into the advanced position, the coupling arm is exposed to the action of the blocking or abutment face only in at least a partial region of the movement path of the push element, and in at least another partial region of the movement path the coupling arm can pivot unhindered without being hindered by the blocking or abutment face.

Yet a further aspect of the invention provides a domestic electrical appliance comprising: a process chamber; a door for closing the process chamber, the door movably mounted on an appliance main body of the domestic appliance; a door opener for automatically partially opening and closing the door; sensor equipment for monitoring a gap which, when the door is in a partially open state, is formed between the door and the appliance main body, for the presence of an object in the gap; and a control unit coupled to the sensor equipment and configured to control the door opener to perform a closing operation, in which the door is automatically closed from the partially open state, in dependence on the sensor equipment detecting the absence of an object in the gap.

Consequently, in this aspect of the invention, it is a requirement for automatic closing of the door by means of the door opener that the gap between the door and the appliance main body is recognized as being clear, that is to say that no object which is not normally expected to be there is detected in the gap. By contrast, if the domestic appliance detects, on the basis of the sensor signals of the sensor equipment, that there is an object in the gap which is not normally present there (e.g. a human finger or other movable object), the domestic appliance is be adapted to control the door opener such that the closing operation is terminated or at least temporarily disabled or otherwise modified. A modification of the closing operation can consist, for example, in temporarily stopping the closing movement of the door effected by means of the door opener or/and temporarily changing the closing movement into an opening movement at least once in order, for example, to give the user or a playing child the opportunity to quickly pull their finger out of the gap.

In some embodiments, the sensor equipment is adapted for the optical or/and capacitive monitoring of at least parts of the gap. Optical monitoring is possible by means of a light barrier assembly, for example. For capacitive monitoring, at least one electrode can be arranged on the door or/and on the appliance main body in the vicinity of the gap, the electrode forming part of an (open or closed) plate capacitor whose capacitance is affected by the presence of an object in the gap. Such capacitance changes can be detected electrically using an oscillating circuit, for example.

BRIEF DESCRIPTION OF THE DRAWINGS

Embodiments of the present invention will be explained in greater detail hereinbelow with reference to the accompanying drawings, in which.

DETAILED DESCRIPTION

Figure 1:
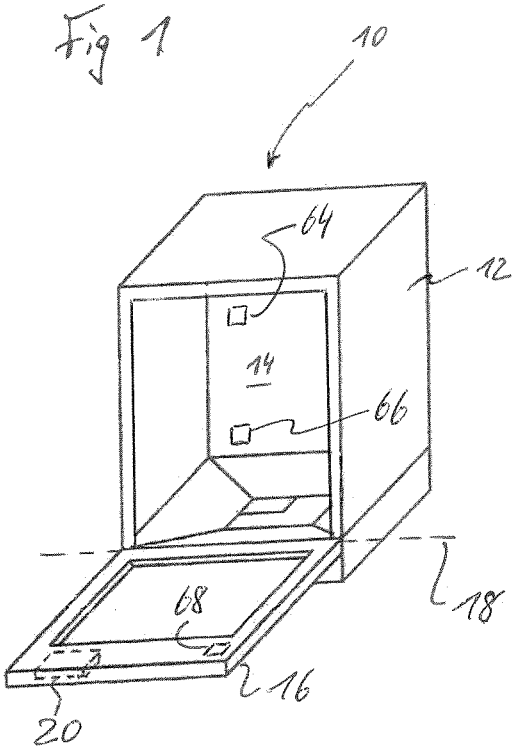
FIG. 1 shows, in diagrammatic form, a domestic dishwasher with the door fully open according to one exemplary embodiment.

Reference will first be made to FIG. 1. The dishwasher shown therein, which is intended for use in a private household, is designated generally 10. It comprises a dishwashing container 12 in the interior of which a dishwashing chamber (wet chamber) 14 is formed. Although not shown in detail in FIG. 1, the dishwashing chamber 14 can be fitted in a manner known per se, for example, with one or more dish racks for holding the dishes to be cleaned. A door 16 is mounted on the dishwashing container 12 so as to be pivotable about a horizontal pivot axis 18 close to the floor. The door 16 can be pivoted between a fully open position shown in FIG. 1, in which it is folded down forward from the dishwashing container 12 substantially into a horizontal position, and a closed position, in which the door is oriented substantially vertically and closes a front access, formed in the dishwashing container 12, to the dishwashing chamber 14.

A control unit 20 indicated by a broken line serves to electrically control the operation of the dishwasher 10. In the example shown, the control unit 20 is arranged in the door 16; it will be appreciated that this arrangement position of the control unit 20 is only by way of example and that, as an alternative, at least parts of the control unit 20 can be installed in the dishwashing container 12. It will likewise be appreciated that the control unit 20—other than is shown in the drawing of FIG. 1—does not have to be formed by a single central control component, but that the functions of the control unit 20 can be realized by multiple sub-units distributed over various locations of the dishwasher 10.

Figure 2A:
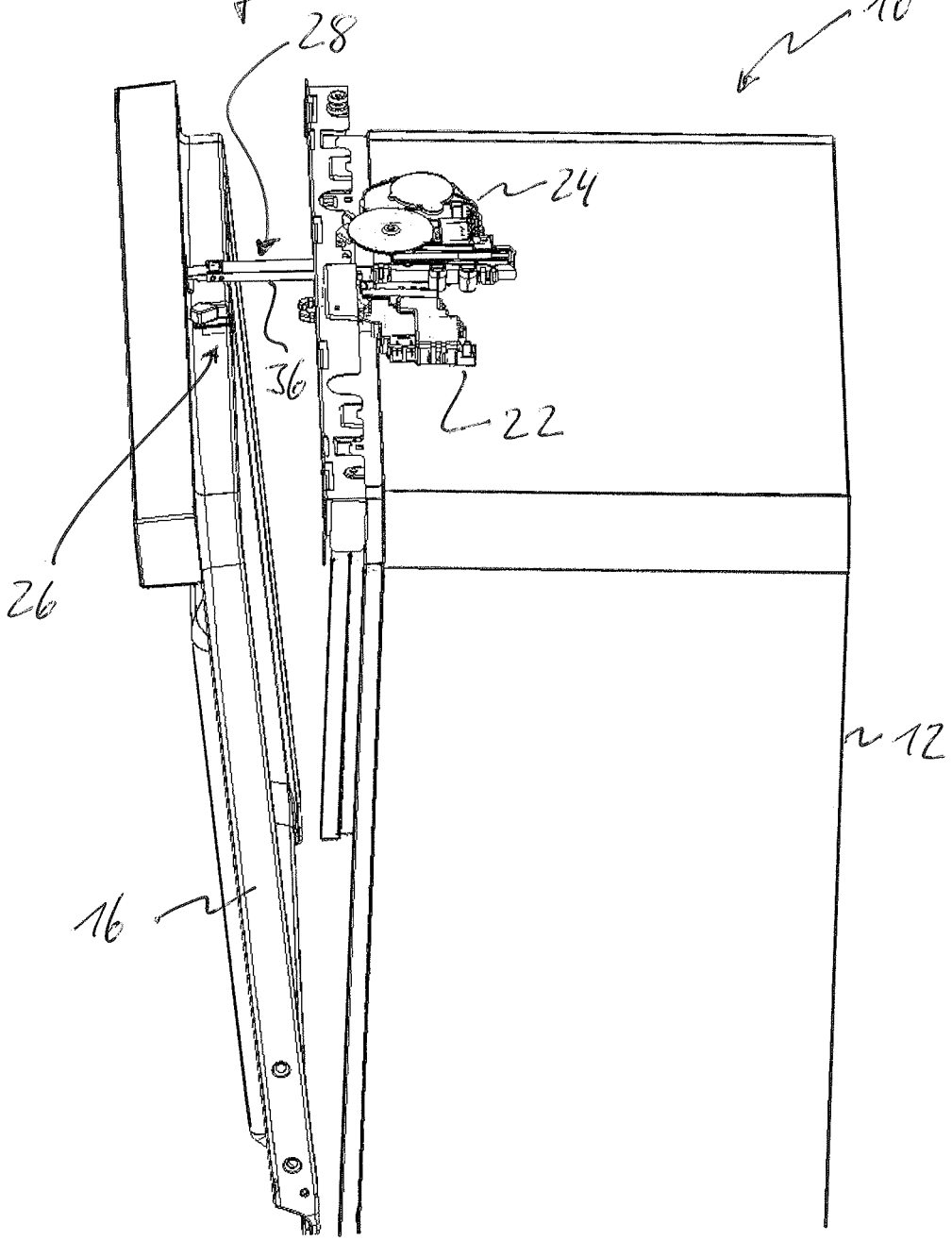
FIG. 2*a* shows, in perspective, an exemplary embodiment of a domestic dishwasher with the door partially open and with the cover plate of a dishwashing container of the machine removed.
Figure 2B:
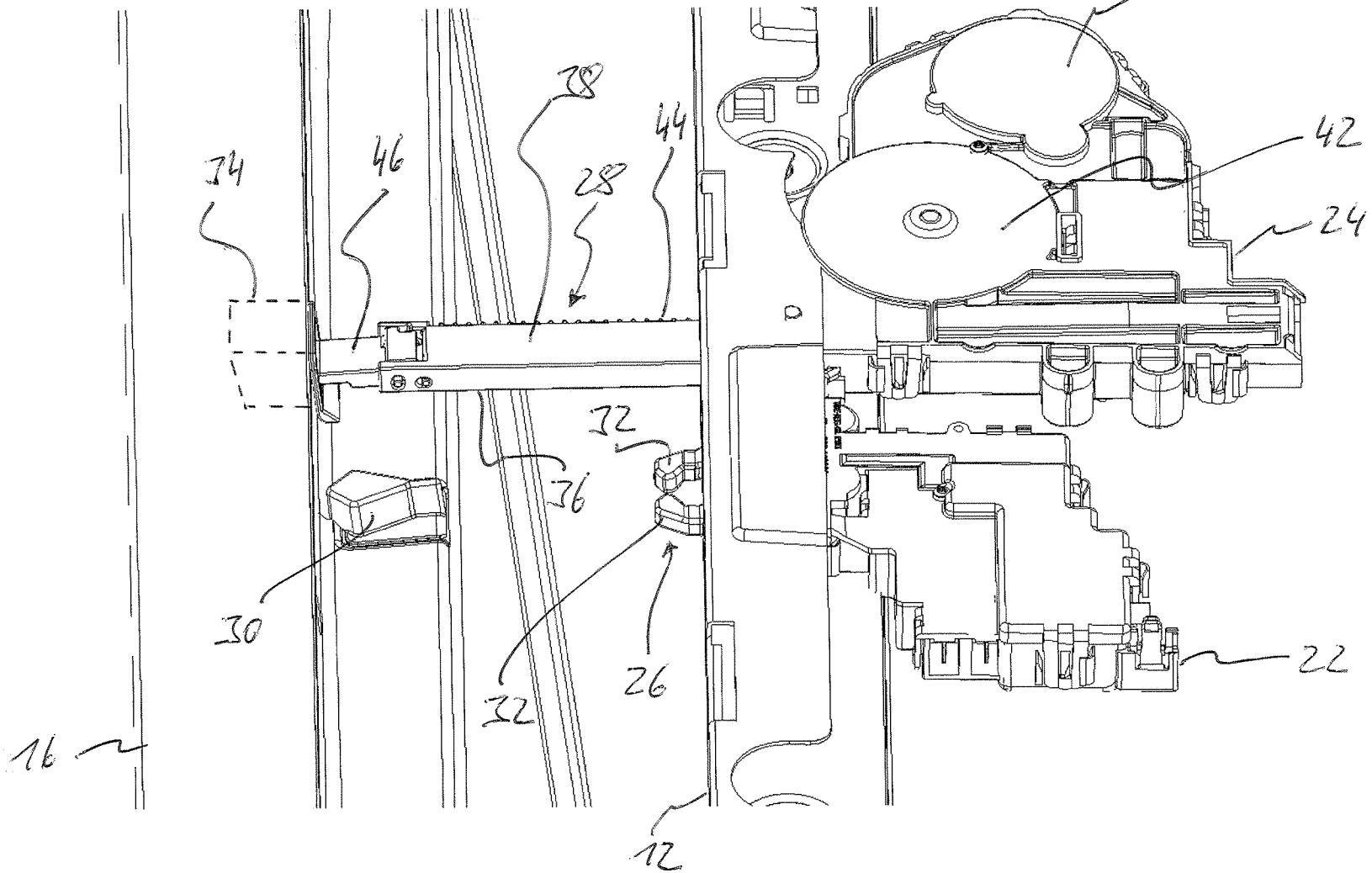
FIG. 2*b* shows an enlarged detail of FIG. 2*a* in order to illustrate a door latch and a door opener of the dishwasher.

FIGS. 2*a*, 2*b* show a concrete exemplary embodiment of the dishwasher 10 indicated only in diagrammatic form in FIG. 1. In this exemplary embodiment, a cover plate which terminates the dishwashing container 12 at the top has been omitted in order to give a view of a latch assembly 22 and an opener assembly 24, which are both installed in the dishwashing container 12 and are part of a door latch designated generally 26 and of a door opener designated generally 28, respectively. The door latch 26 serves to hold the door closed in the closed position; in the example shown, it comprises a latch head 30 arranged on the door 16 and two latch arms 32, provided as part of the latch assembly 22, which can be deflected away from one another against a closing spring force and, when the door is closed, clasp the latch head 30 on both sides in the manner of two jaws. On closing of the door 16, the latch head 30 is inserted between the two latch arms 32 and urges them apart against the action of the closing spring force until the latch head 30 has ultimately moved sufficiently far between the latch arms 32 and the latch arms 32 are able to snap back behind the latch head 30 toward their rest position. The closing spring force, which acts against the latch arms 32 being urged apart, constitutes a closing resistance which is to be overcome on closing of the door 16. Further details of the door latch 26 can be found, for example, in DE 10 2012 016 541 A1, the content of which is hereby incorporated by explicit reference in its entirety. It will be appreciated that the invention is not limited to the form of the door latch 26 with the latch head 30 and the pair of latch arms 32 that is shown; other latch constructions are equally conceivable for the door latch 26.

The door opener 28 serves for the mechanized (i.e. non-manual) partial opening and closing of the door 16. For this purpose, the door opener 28 comprises a coupling member 34 on the door (which is shown in detail in FIGS. 3*a* to 5*b* and is indicated only diagrammatically by a broken line in FIG. 2*b*) and a coupling member 36 on the container. The coupling members 34, 36 can be brought into mutual coupling engagement by being moved toward one another, that is to say by a movement of the door 16 in the closing direction, and can be brought out of coupling engagement being moved away from one another, that is to say by a movement of the door 16 in the opening direction. The coupling engagement between the coupling members 34, 36 is consequently releasable. However, in the exemplary embodiment shown, this does not apply for the entire pivoting range of the door 16 between the closed position of the door and a maximum partially open position of the door 16 that is achievable by operation of the door opener 28.

The possibility of releasing the coupling engagement by manually pulling the door 16 is provided when the door 16 is fully closed; it is also provided in the position of maximum partial opening of the door 16 shown in FIGS. 2*a*, 2*b* (i.e. maximum possible partial opening that is achievable by operation of the door opener 28). The latter position can also be referred to as a partially open end position, since it represents an end point of a partial opening of the door 16 which can be effected by means of the door opener 28. In a region between the completely closed position of the door 16 and the mentioned partially open end position, the coupling engagement between the coupling member 34 arranged on the door 16 and the coupling member 36 arranged on the dishwashing container 12 is modified or increased to the extent that greater pulling forces can be transmitted between the two coupling members 34, 36 than in the closed position and the partially open end position of the door 16.

The possibility of transmitting greater pulling forces means a stronger pulling coupling of the coupling members 34, 36 and thus that manual opening of the door 16 is more difficult or is even prevented. The pull strength of the coupling engagement of the coupling members 34, 36, which is increased in phases during a closing operation effected by means of the door opener 28, allows the closing resistance of the door latch 26 arranged in a force transmission path that is mechanically parallel to the door opener 28 to be overcome without the coupling engagement between the coupling members 34, 36 unintentionally being released. On mechanized opening of the door 16 by means of the door opener 28 starting from the completely closed position of the door, the latch head 30 is released from the clasp of the latch arms 32; the door latch 26 opens. In the case of a closing operation of the door 16 effected by means of the door opener 28, the latch head 30 must again enter between the latch arms 32, for which purpose the closing spring force acting on the latch arms 32 must be overcome. Consequently, it must be possible to transmit a pulling force between the coupling members 34, 36 which is increased in phases in order for the door latch 26 to be able to be closed again. In order to ensure this, the pull strength of the coupling engagement of the coupling members 34, 36 is increased in the exemplary embodiment shown at least in a phase in which, on closing of the door 16, the door opener 28 must work against the closing spring force of the latch arms 32.

In the exemplary embodiment shown, the coupling member 36 on the container comprises a push rod 38 which is arranged on the dishwashing container 12 so as to be linearly displaceable in its rod longitudinal direction. For driving the push rod 38, the opener assembly 24 comprises an electrically controllable actuator 40, which is in the form of an electric motor, for example. Via a gear assembly, not shown in detail, which can act in a reducing manner and is arranged in a region 42 of the opener assembly 24, the driving force of the electric motor can be transmitted to the push rod 38. For this purpose, the push rod 38 is designed in the example shown with a toothing 44, which in a manner not shown in detail is in meshing engagement with a pinion, on the output side, of the gear assembly. The direction of rotation of the electric motor is reversible, so that, depending on the direction of rotation of the electric motor, the push rod 38 can be moved out in the direction toward an advanced position or moved back in the direction toward a retracted position. Operation of the electric motor, or of the actuator 40, is controlled by a control unit, for example the control unit 20 of FIG. 1.

In the region of the front rod end, a coupling arm 46 is pivotably mounted on the push rod 38. The coupling arm 46 is configured for push- and pull-transmitting engagement with the coupling member 34 on the door. By driving the push rod 38, the door 16, provided that the coupling arm 46 and the coupling member 34 on the door are correspondingly coupled, can be pushed open from the closed state and pulled shut again into the closed position.

Reference will now additionally be made to FIGS. 3*a* to 5*b*. It can be seen in those figures that in the exemplary embodiment shown the coupling member 34 on the door forms a pocket 48 into which the coupling arm 46 can be inserted with a front (free) arm end region 50 of hook-like form. The pocket is delimited at its pocket base by a wall section 52 against which the coupling arm 46 can push with its arm end region 50 in order to transmit pushing forces from the coupling member 36 to the coupling member 34 and thereby open the door 16. The transmission of pulling forces from the coupling member 36 to the coupling member 34 takes place via a tooth-like coupling projection 54 which is formed on one of the side walls of the coupling member 34 that delimit the pocket 48 and which projects into the pocket 48. The coupling arm 46 forms at its arm end portion 50 a coupling lug 56 with which the coupling arm 46 can pivot behind a recessed flank 58 of the coupling projection 54. As a result of the coupling arm 46 hooking the flank 58 of the coupling projection 54 with its coupling lug 56, pulling forces can be transmitted from the coupling member 36 to the coupling member 34 and thus the door 16 can be closed. The level of pulling forces that can be transmitted is limited by a suitably inclined profile of the flank 58 or/and of the coupling lug 56; if a specific level of transmitted pulling forces is exceeded, the coupling lug 56 slides off the flank 58 in that the coupling arm 46 pivots upward (in the illustration of FIGS. 3*a* to 5*b*) relative to the push rod 38, so that the coupling lug 56 can move over the coupling projection 54 and out of the pocket 48. The coupling projection 54 and the coupling lug 56 form cooperating pulling coupling formations within the meaning of the invention.

Provided that the coupling arm 46 is not blocked against pivoting deflection relative to the push rod 38, the pull strength of the coupling engagement between the coupling lug 56 and the coupling projection 54 is such that, although the door 16 can be pulled out of the partially open end position according to FIGS. 2*a*, 2*b* in the direction toward the closed position, the coupling arm 46 slides from the coupling projection 54 comparatively easily if resistance is encountered, as occurs, for example, if the door 16 comes into contact with a human finger placed into the opening gap between the door 16 and the dishwashing container 12. In this manner, painful hand injuries can be avoided should a user or a playing child inadvertently or even intentionally put a finger into the opening gap while the door opener 28 is being operated for an automatic closing operation of the door 16.

In particular, this initial pull strength of the coupling engagement between the coupling projection 54 and the coupling lug 56 (initial when considered starting from the partially open end position according to FIGS. 2*a*, 2*b*) is not sufficiently great to force the latch head 30 between the latch arms 32. Therefore, in the exemplary embodiment shown, when the latch arms 32 reach the latch head 30 or slightly before, the coupling arm 46 is blocked against pivoting out of the engagement position (coupled pivot position), in which the coupling arm 46 is hooked behind the coupling projection 54. In the exemplary embodiment shown, a blocking element 62 is provided for this purpose on a rod guiding unit 60 which serves for linear guiding of the push rod 38 and is stationary relative to the dishwashing container 12, which blocking element, in a specific part of the pushing movement path of the push rod 38, prevents the coupling arm 46 from pivoting relative to the push rod 38. In other parts of the pushing movement path of the push rod 38, the coupling arm 46 is to a certain extent out of reach of the blocking body 62 and is not blocked thereby against pivoting relative to the push rod 38.

Figure 3A:
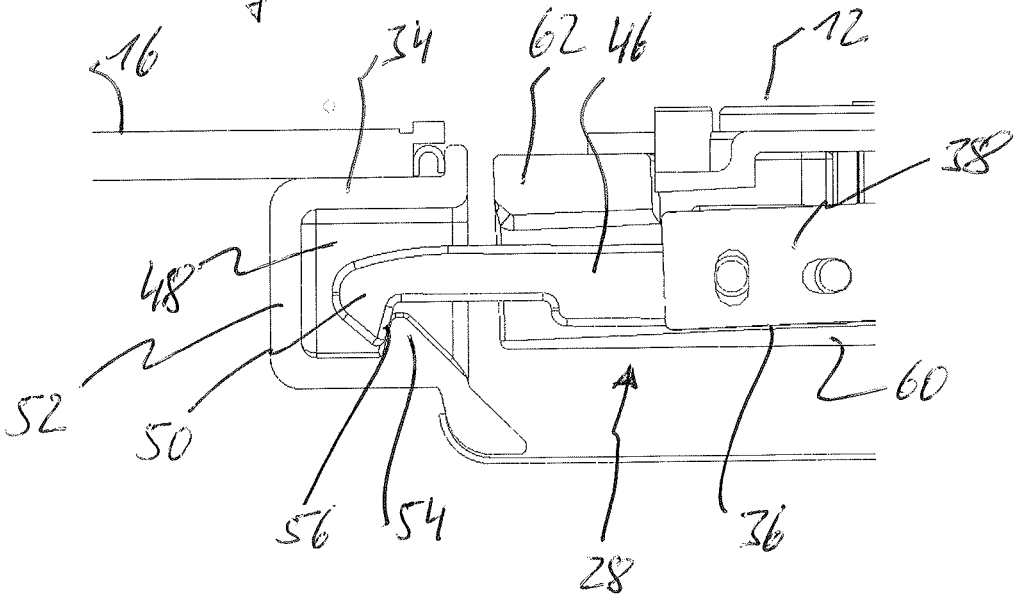
FIG. 3*a* shows cooperating coupling members of the door opener of the dishwasher of FIGS. 2*a*, 2*b* in a state in which the door is closed.
Figure 3B:
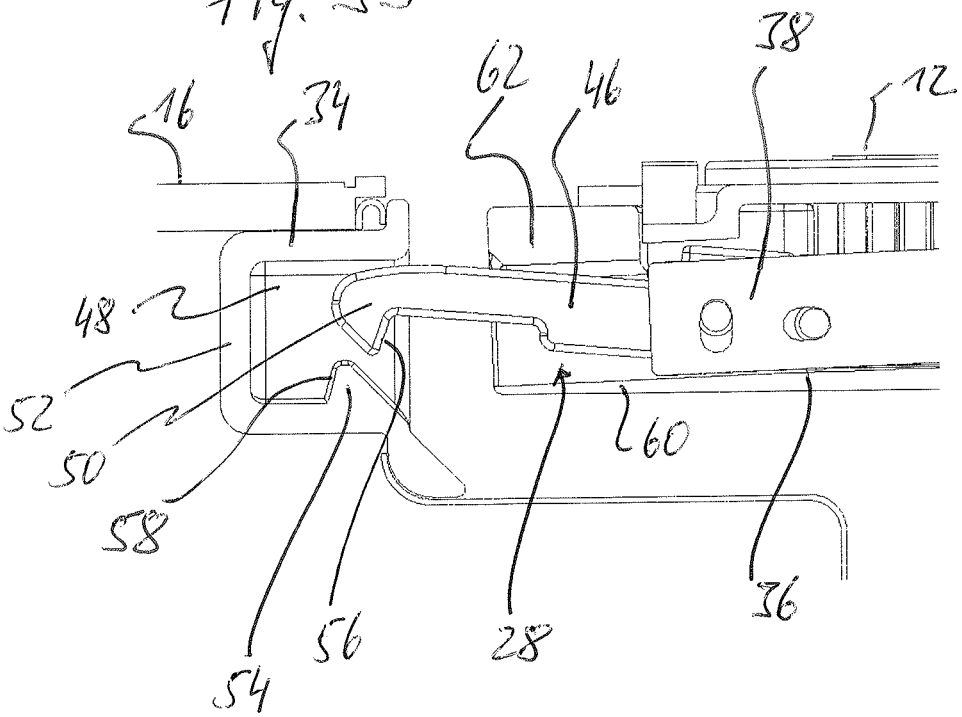
FIG. 3*b* shows the coupling members of FIG. 3*a* in a state in which the door has been partially opened manually.

FIG. 3*a* shows a state when the door 16 is closed. The coupling arm 46 is pivoted with its coupling lug 56 behind the flank 58 of the coupling projection 54, and the coupling arm 46 is free to pivot relative to the push rod 38, that is to say it is not blocked by the blocking element 62. If the door 16 is pulled manually starting from the state shown in FIG. 3*a*, the engagement of the coupling arm 46 with the coupling projection 54 can therefore be released without difficulty in that the coupling lug 56 slides upward on the flank 58 of the coupling projection 54 and finally the coupling lug 56 slides over the coupling projection 54. This situation is shown in FIG. 3*b*. When the door is closed, it should be possible for the user to open the door 16 manually with little effort. Therefore, the pull strength of the coupling engagement between the two coupling members 34, 36 is comparatively low when the door 16 is closed.

Figure 4:
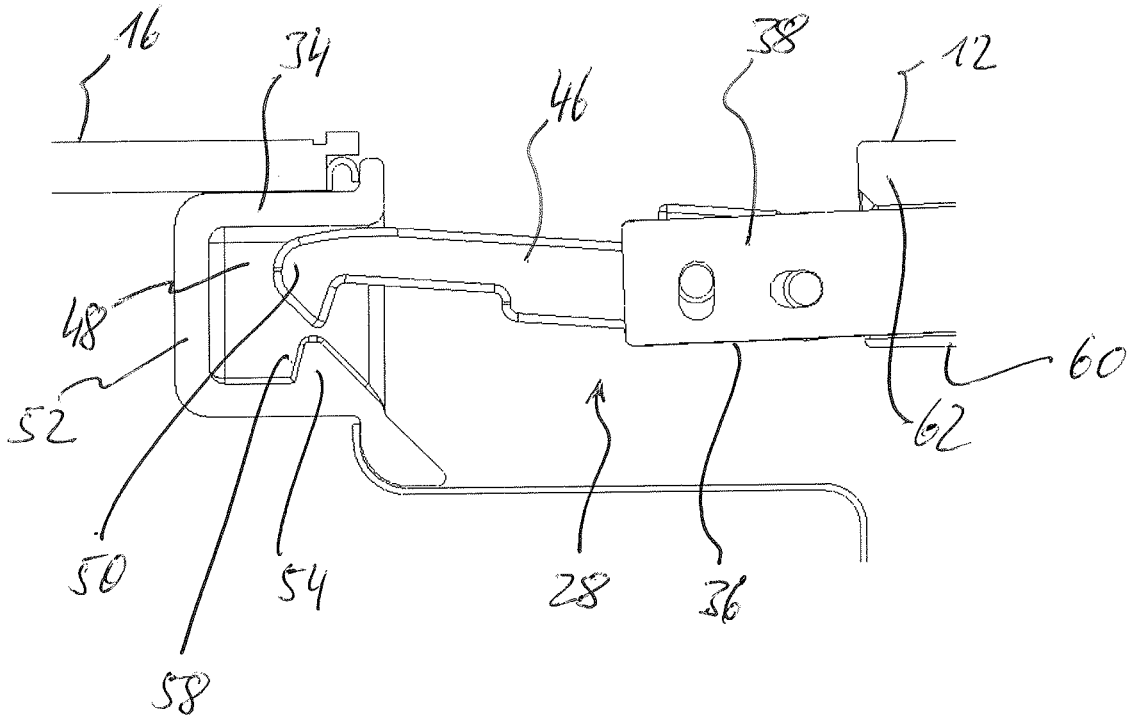
FIG. 4 shows the coupling members of FIG. 3*a* in a state after the door has been partially opened automatically and after it has subsequently been opened further manually.

Even when the door 16 has been partially opened by means of the door opener 28, that is to say has been brought into the partially open end position according to FIGS. 2*a*, 2*b*, it is desirable for a user to be able to manually open the door completely with little effort. Therefore, in the partially open end position, the coupling arm 46 is also not blocked by the blocking body 62 against pivoting relative to the push rod 38. FIG. 4 shows a state after, starting from the partially open end position of the door 16, the door has manually been opened slightly wider and the coupling engagement between the coupling arm 46 and the coupling projection 54 has been released as a result of the manual pulling force which has been exerted. The push rod 38 has been advanced into a front end position in FIG. 4; by contrast, FIGS. 3*a*, 3*b* show the push rod 38 retracted into a rear end position. The distance between the rear end position according to FIGS. 3*a*, 3*b* and the front end position according to FIG. 4 is, for example, a few centimeters, e.g. between about 5 cm and about 9 cm.

Figure 5A:
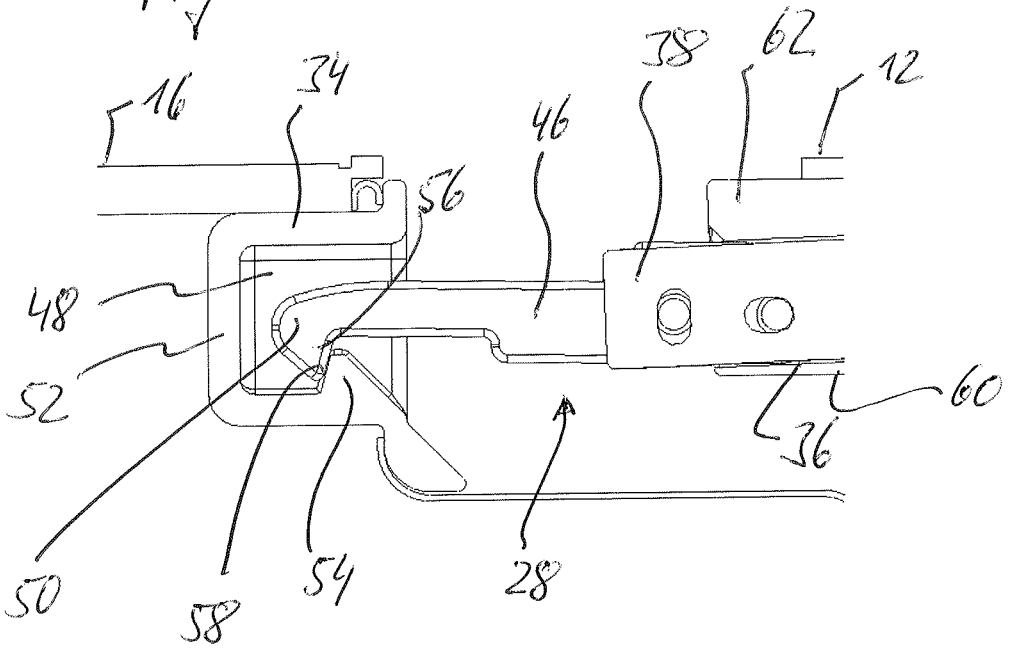
FIG. 5*a* shows the coupling members of FIG. 3*a* in a state during an automatic closing operation in a phase in which a coupling arm is blocked against release of the coupling engagement of the coupling members.
Figure 5B:
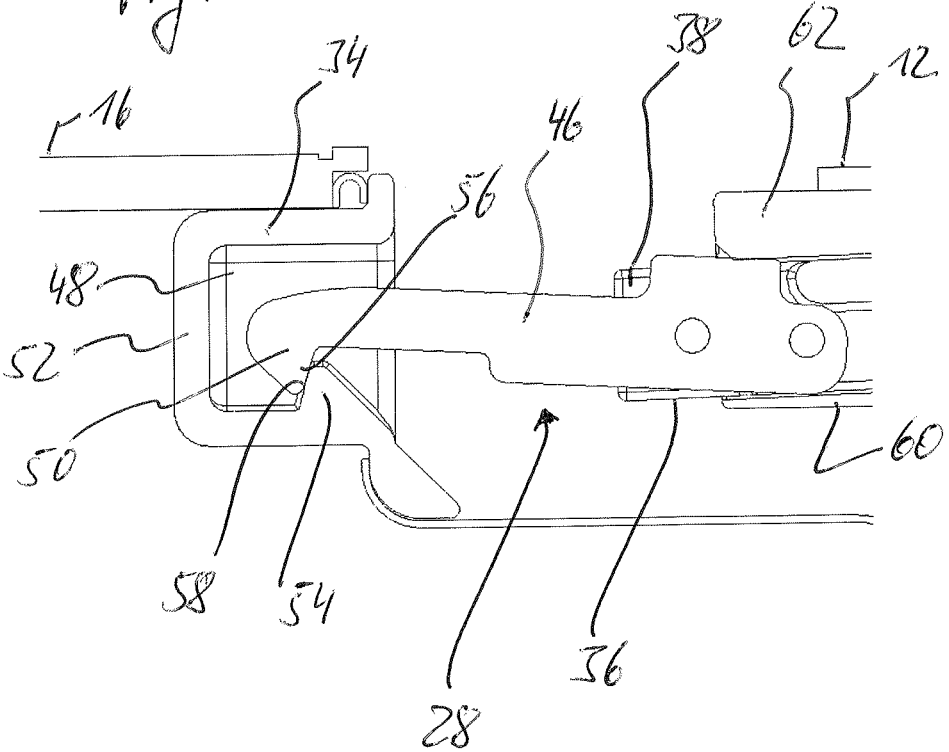
FIG. 5*b* is a view corresponding to FIG. 5*a* but in a sectional plane set into the plane of the drawing of FIG. 5*a*.

Finally, FIGS. 5*a*, 5*b* show a state of the door opener 28 in which the push rod 38 occupies an intermediate position, in which it has been advanced slightly from the rear end position but is still at a distance from the front end position. In this intermediate position, the blocking body 62 has a blocking action on the coupling arm 46; the coupling arm is therefore unable to pivot relative to the push rod 38 and the engagement between the coupling lug 56 of the coupling arm 46 and the flank 58 of the coupling projection 54 cannot be released even when high pulling forces are exerted. The blocking of the coupling arm 46 against pivoting relative to the push rod 38 consequently means a relatively increased pull strength of the coupling engagement between the coupling members 34, 36.

In the example shown, the latch assembly 22 and the opener assembly 24 are separate assemblies which can be mounted on the dishwashing container 12 independently of one another. It will be appreciated that the functions of the latch assembly 22 (with the two spring-pretensioned latch arms 32) and of the opener assembly 24 (with the push rod 38 and the associated drive device) can be combined in a common assembly, which as such can be mounted on the dishwashing container 12.

The door opener 28 can be controlled such that, after a program-controlled opening of the door 16, it initiates a closing operation, likewise under program control, in order to pull the partially opened door shut again. The correct time for automatic closing of the door 16 after preceding automatic opening can depend, for example, on a predefined time parameter which is taken into consideration in the control program of the door opener 28. Alternatively or additionally, the control program of the door opener 28 can take into consideration a temperature parameter or/and a humidity parameter. For example, it is conceivable to activate the door opener 28 for the purpose of closing the door 16 as soon as the temperature in the dishwashing chamber 14 has fallen to a specific temperature or by a specific temperature difference. A temperature sensor, as is indicated diagrammatically in FIG. 1 at 64, can be provided at a suitable location in the dishwashing chamber 14 for the temperature measurement. Alternatively or additionally, the dishwasher 10 can be equipped with a humidity sensor 66 (FIG. 1), which can provide a measured value representative of the humidity in the dishwashing chamber 14. The control unit 20 can control the closing operation of the door opener 28 in dependence on the signals of the temperature sensor 64 or/and of the humidity sensor 66 or/and in dependence on a measured period of time since the last automatic opening of the door 16. In particular, the control unit 20 can be programmed such that it can control the door opener 28 for repeated automatic opening with intermediate automatic closing. In this manner, hot steam can be discharged from the dishwashing chamber 14 in several stages.

According to a further modification, the dishwasher 10 could be equipped with one or more sensors 68 (FIG. 1) which are capable, by applying an optical or/and capacitive measurement principle, of detecting the presence of a human finger or other object in the opening gap between the door 16 and the dishwashing container 12 that forms in the partially open end position of the door 16. The control unit 20 can be adapted to evaluate the signals of the or each sensor 68 or to operate the door opener 28 for a closing operation only in dependence on the opening gap being free of objects which are not expected there. With such a configuration of the control unit 20, a pull strength of the coupling engagement of the coupling members 34, 36 that is changeable depending on the position of the door is not required and accordingly a structural configuration of the coupling members 34, 36 other than that shown in FIGS. 2*a* to 5*b* can be chosen. In particular, with such a configuration of the control unit 20, the coupling members 34, 36 can be so designed that they provide a substantially constant, comparatively high pull strength of the coupling engagement over the entire pivot path of the door 16 between the partially open end position and the closed position, sufficient to overcome the closing resistance of the door latch 26.

What is claimed is:

1. A domestic electrical appliance comprising:

a process chamber;

a door for closing the process chamber;

a door opener device for automatically partially opening and closing the door; and a control unit configured to control the door opener device to perform at least one of the following operation cycles during execution of an operating program of the appliance:

an open-close cycle of partially opening the door and subsequently closing, in at least one of a temperature-controlled manner, a time-controlled manner and a humidity-controlled manner, the partially opened door; and a repeat-open cycle of repeatedly partially opening the door and closing the door therebetween;

wherein the door opener device comprises coupling members, which are configured to be brought into push- and pull-transmitting but releasable coupling engagement with one another, on the door and on an appliance main body of the domestic appliance on which the door is movably mounted, wherein the coupling members, when in coupling engagement, are designed to allow forces to be transmitted between the door and the appliance main body in a force transmission path which bypasses a door latch, wherein a pull strength of the coupling engagement is variable;

wherein a first of the coupling members comprises a pivotably arranged coupling arm having a coupling lug with which the coupling arm is pivotable out of a released pivot position behind a recess of a second of the coupling members into a coupled pivot position in order to establish pull-transmitting coupling engagement; and wherein, in order to increase a pull strength of the pull-transmitting coupling engagement, pivoting of the coupling arm out of the coupled pivot position back into the released pivot position can be impeded or blocked.

2. The domestic electrical appliance of claim 1, wherein the control unit is configured to control the door opener device to perform the at least one operation cycle on completion of a wet operating phase of the operating program.

3. A door mechanism for a domestic electrical appliance, the door mechanism comprising:

a door latch for holding a door of the domestic appliance closed in a closed position; and a door opener for the mechanized partial opening and subsequent closing of the door, wherein the door opener comprises coupling members, which are configured to be brought into push- and pull-transmitting but releasable coupling engagement with one another, on the door and on an appliance main body of the domestic appliance on which the door is movably mounted, wherein the coupling members, when in coupling engagement, are designed to allow forces to be transmitted between the door and the appliance main body in a force transmission path which bypasses the door latch, wherein a pull strength of the coupling engagement is variable;

wherein a first of the coupling members comprises a pivotably arranged coupling arm having a coupling lug with which the coupling arm is pivotable out of a released pivot position behind a recess of a second of the coupling members into a coupled pivot position in order to establish pull-transmitting coupling engagement; and wherein, in order to increase a pull strength of the pull-transmitting coupling engagement, pivoting of the coupling arm out of the coupled pivot position back into the released pivot position can be impeded or blocked.

4. The door mechanism of claim 3, wherein the pull strength of the coupling engagement varies in dependence on the relative position between the door and the appliance main body.

5. The door mechanism of claim 4, wherein the pull strength of the coupling engagement is lower in a first partially open position, in which the door is open wider, than in a second partially open position, in which the door is open less wide.

6. The door mechanism of claim 5, wherein the pull strength of the coupling engagement is lower in the closed position of the door than in the second partially open position.

7. The door mechanism of claim 3, wherein a transfer of the door, effected by means of the door opener and starting from the closed position of the door, into a partially open end position separates a force-based connection between the appliance main body and the door via the door latch, wherein a subsequent closing of the door effected by means of the door opener re-establishes the force-based connection between the appliance main body and the door via the door latch, wherein the pull strength of the coupling engagement in the partially open end position is not sufficient to overcome a closing resistance of the door latch, and wherein, on closing of the door by means of the door opener, the pull strength of the coupling engagement increases at least temporarily to an extent that is sufficient to overcome the closing resistance of the door latch.

8. The door mechanism of claim 3, wherein the pull strength of the coupling engagement is variable stepwise.

9. The door mechanism of claim 3, wherein the coupling members have pulling coupling formations which are arranged so as to be deflectable relative to one another, wherein the pull strength of the coupling engagement can be increased by blocking or impeding the relative deflectability of the pulling coupling formations.

10. The door mechanism of claim 3, wherein the coupling arm is pivotably mounted on a push element which is arranged so as to be movable between an advanced position and a retracted position, wherein, along a movement path of the push element between the advanced position and the retracted position, pivoting of the coupling arm out of the coupled pivot position into the released pivot position is relatively easier in at least a partial region of the movement path and is relatively more difficult or is prevented in at least another partial region of the movement path.

11. The door mechanism of claim 10, wherein, both in the advanced position and in the retracted position of the push element, pivoting of the coupling arm out of the coupled pivot position into the released pivot position is relatively easier and, in a partial region of the movement path between the advanced position and the retracted position of the push element, such pivoting is relatively more difficult or is prevented.

12. A domestic electrical appliance comprising:

a process chamber;

a door for closing the process chamber, the door movably mounted on an appliance main body of the domestic appliance;

a door opener for automatically partially opening and closing the door;

sensor equipment for monitoring a gap which, when the door is in a partially open state, is formed between the door and the appliance main body, for the presence of an object in the gap; and a control unit coupled to the sensor equipment and configured to control the door opener to perform a closing operation, in which the door is automatically closed from the partially open state, in dependence on the sensor equipment detecting the absence of an object in the gap;

wherein the door opener comprises coupling members, which are configured to be brought into push- and pull-transmitting but releasable coupling engagement with one another, on the door and on the appliance main body of the domestic appliance on which the door is movably mounted, wherein the coupling members, when in coupling engagement, are designed to allow forces to be transmitted between the door and the appliance main body in a force transmission path which bypasses a door latch, wherein a pull strength of the coupling engagement is variable;

wherein a first of the coupling members comprises a pivotably arranged coupling arm having a coupling lug with which the coupling arm is pivotable out of a released pivot position behind a recess of a second of the coupling members into a coupled pivot position in order to establish pull-transmitting coupling engagement; and wherein, in order to increase a pull strength of the pull-transmitting coupling engagement, pivoting of the coupling arm out of the coupled pivot position back into the released pivot position can be impeded or blocked.

13. The domestic appliance of claim 12, wherein the sensor equipment is adapted to monitor at least parts of the gap by at least one of optical monitoring and capacitive monitoring.

14. The domestic appliance of claim 12, wherein the domestic appliance is adapted to control the door opener to prevent, terminate or modify the closing operation in dependence on the sensor equipment detecting the presence of an object in the gap.

* * * * *